United States Patent [19]

Evans et al.

[11] Patent Number: 5,024,931

[45] Date of Patent: Jun. 18, 1991

[54] PHOTOGRAPHIC EMULSIONS SENSITIZED BY THE INTRODUCTION OF OLIGOMERS

[75] Inventors: Francis J. Evans, Rochester; Ralph W. Jones, Jr., Hilton; Robert D. Wilson, Rochester, all of N.Y.

[73] Assignee: Eastman Kodak Company, Rochester, N.Y.

[21] Appl. No.: 461,504

[22] Filed: Jan. 5, 1990

[51] Int. Cl.[5] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 2,448,060 | 8/1948 | Smith et al. | 95/7 |
| 4,835,093 | 5/1989 | Janusonis et al. | 430/567 |
| 4,933,272 | 6/1990 | McDugle et al. | 430/567 |
| 4,937,180 | 6/1990 | Marchetti et al. | 430/567 |

OTHER PUBLICATIONS

B. H. Carroll, "Iridium Sensitization: A Literature Review", *Photographic Science and Engineering*, vol. 24, No. 6, Nov./Dec. 1980, pp. 265-267.

*Primary Examiner*—Charles L. Bowers, Jr.
*Assistant Examiner*—Janet C. Baxter
*Attorney, Agent, or Firm*—Carl O. Thomas

[57] ABSTRACT

A photographic silver halide emulsion is disclosed in which the face centered cubic crystal lattice structure of the grains contain at adjacent cation sites metal ions chosen from group VIII, periods 5 and 6. The metal ions are placed at adjacent cation lattice sites by sensitizing the grains with oligomers each containing at least two of the group VIII metal ions.

20 Claims, 1 Drawing Sheet

PHOTOGRAPHIC EMULSIONS SENSITIZED BY THE INTRODUCTION OF OLIGOMERS

FIELD OF THE INVENTION

The invention relates to photography. More specifically, the invention relates to photographic silver halide emulsions and to processes for their preparation.

PRIOR ART

Smith and Trivelli U.S. Pat. No. 2,448,060, issued Aug. 31, 1948, taught that silver halide emulsions can be sensitized by adding to the emulsion at any stage of preparation—i.e., before or during precipitation of the silver halide grains, before or during the first digestion (physical ripening), before or during the second digestion (chemical ripening), or just before coating, a compound of a metal having an atomic weight greater than 100 chosen from group VIII of the periodic table of elements, such as those identified by the formula:

$$R_2MX_6 \quad (I)$$

wherein

R represents hydrogen, alkali metal, or ammonium,

M represents a group VIII, period 5 or 6, metal (i.e., ruthenium, rhodium, palladium, osmium, iridium, or platinum), and X represents a halogen atom.

Useful concentrations are taught to be as low as 0.8 mg/100 g of silver.

Although all of the group VIII, period 5 and 6 metals (hereinafter generically referred to as group VIII 5/6 metals), have been shown to be effective in modifying the properties of silver halide emulsions, iridium has been most extensively used and studied. B. H. Carroll, "Iridium Sensitization: A Literature Review", *Photographic Science and Engineering*, Vol. 24, No. 6, Nov./-Dec. 1980, pp. 265-267, is cited for further background on conventional photographic uses of iridium.

Janusonis et al U.S. Pat. No. 4,835,093 as well as McDugle et al U.S. Ser. No. 179,376, (U.S. Pat. No. 4,933,272); Keeyert et al U.S. Ser. No. 179,377, (U.S. Pat. No. 4,945,035); and Marchetti et al U.S. Ser. No. 179,378, (U.S. Pat. No. 4,937,180) each filed Apr. 8, 1988, disclose the incorporation of hexacoordination complexes of transition metal ions in the face centered cubic crystal lattice structure of silver halide grains to achieve useful modifications of photographic performance.

SUMMARY OF THE INVENTION

In one aspect the invention is directed to a photographic silver halide emulsion comprised of radiation sensitive silver halide grains exhibiting a face centered cubic crystal lattice structure containing at adjacent cation sites of the crystal lattice metal ions chosen from group VIII, periods 5 and 6.

In another aspect the invention is directed to a method of preparing a photographic emulsion comprising forming radiation sensitive silver halide grains exhibiting a face centered cubic crystal lattice structure containing metal ions chosen from group VIII, periods 5 and 6. The method is characterized in that the group VIII metal ions are supplied in the form of oligomers each containing at least two of the group VIII metal ions.

DESCRIPTION OF PREFERRED EMBODIMENTS

Figure 1:
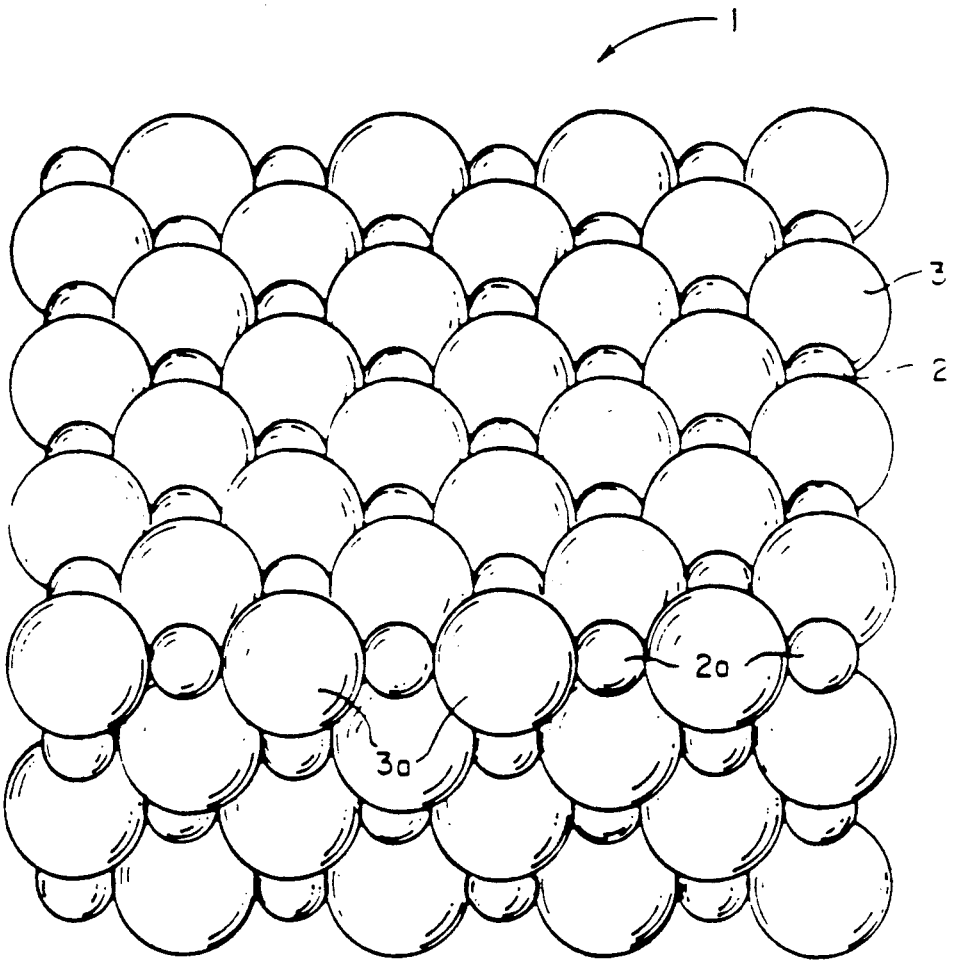
FIG. 1 is a schematic view of a silver bromide crystal structure with the upper layer of ions lying along a {100} crystallographic face.

The present invention is based on the discovery that the photographic effect of group VIII 5/6 metal ions associated with radiation sensitive silver halide grains can be dramatically enhanced by positioning the group VIII 5/6 metal ions in adjacent cation positions in the face centered cubic crystal lattice structure of the grains.

Unlike silver iodide, which commonly forms only $\beta$ and $\gamma$ phases, silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of ions shown counting from the bottom of FIG. 1 lie in a {100} crystallographic plane which perpendicularly intersects the {100} crystallographic plane occupied by the upper layer of ions. The row containing silver ions 2*a* and bromide ions 3*a* lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for eac interior bromide ion.

The arrangement of ions in a silver chloride crystal is the same as that shown in FIG. 1, except that chloride ions are smaller than bromide ions. Silver halide grains in photographic emulsions can be formed of bromide ions as the sole halide, chloride ions as the sole halide, or any mixture of the two. It is also common practice to incorporate minor amounts of iodide ions in photographic silver halide grains. Since chlorine, bromine, and iodine are 3rd, 4th, and 5th period elements, respectively, the iodide ions are larger than the bromide ions.

As much as 40 mole percent of the total halide in a silver bromide cubic crystal lattice structure can be accounted for by iodide ions before silver iodide separates as a separate phase. In photographic emulsions iodide concentrations in silver halide grains seldom exceed 20 mole percent and are typically less than 10 mole percent, based on silver. However, specific applications differ widely in their use of iodide. Silver bromoiodide emulsions are employed in high speed (ASA 100 or greater) camera films, since the presence of iodide allows higher speeds to be realized at any given level of granularity. Silver bromide emulsions or silver bromoiodide emulsions containing less than 5 mole percent iodide are customarily employed for radiography. Emulsions employed for graphic arts and color paper typically contain greater than 50 mole percent, preferably greater than 70 mole percent, and optimally greater than 85 mole percent, chloride, but less than 5 mole percent, preferably less than 2 mole percent, iodide, any balance of the halide not accounted for by chloride or iodide being bromide.

The present invention is based on the discovery that, when adjacent cation positions of the face centered cubic crystal structure of silver halide grains are occupied by group VIII 5/6 metal ions, they exhibit a disproportionately large effect on photographic performance as compared to that demonstrated by photographic emulsions in which the same group VIII 5/6 metal ions have been similarly introduced, but without any mechanism to achieve adjacent cation lattice placement. While a single pair, on average, of adjacent group VIII 5/6 metal ions incorporated in the crystal lattice of the radiation sensitive grains of an emulsion is effective to enhance photographic performance, it is preferred to incorporate at least five pairs, on average, of adjacent group VIII 5/6 metal ions in the radiation sensitive grains, preferably at least ten pairs, on average. Average pair incorporations can be determined merely by dividing half the number of metal ions incorporated by the number of radiation sensitive silver halide grains present in the emulsion. The latter can be determined from a knowledge of mean grain size, grain shape, and the halide and silver content of the emulsion. The actual distribution of group VIII 5/6 metal ions within the grains can be expected to follow a Poisson error function distribution with the mean metal ion incorporation corresponding to the distribution mode.

The minimum group VIII 5/6 metal ion incorporations per grain satisfying the requirements of this invention are far below the minimum concentration levels of group VIII 5/6 metal ions taught to be effective by the art. For example, Smith and Trivelli, cited above, disclose a minimum concentration of group VIII 5/6 metal coordination complex of 0.8 mg/100 grams of silver. When 100 group VIII 5/6 metal ions per grain are present in the emulsions of this invention, the coordination complex concentration in mg/100 grams of silver is still less than a $\frac{1}{8}$ the minimum level taught to be effective by Smith and Trivelli. When emulsions with adjacent pairs of group VIII 5/6 metal ions are compared with conventional emulsions with random crystal lattice placements of group VIII 5/6 metal ions at concentrations ranging from minimums of 2, 10, or 20 group VIII 5/6 metal ions per grain up to 100 group VIII 5/6 metal ions per grain and higher, superior photographic enhancement by the emulsions satisfying the requirements of the invention are realized.

Once a sufficient number of adjacent pairs of group VIII 5/6 metal ions are incorporated into the grains to achieve maximum photographic efficiency, no useful purpose is realized by further increasing the presence of group VIII 5/6 metal ions. The present invention does not, however, prevent the inclusion of group VIII 5/6 metal ions, incorporated entirely or only partially as adjacent lattice position pairs, up to the maximum useful concentration levels taught in the art for group VIII 5/6 metal ion incorporation.

When group VIII metal ions from period 5 are incorporated at the concentration limit of Smith and Trivelli, less than approximately 40 mg/100 grams of silver, only elementary calculations are required to observe that there are only about 4 atoms of the period 5 group VIII metal per 10,000 atoms of silver. When the group VIII metal is chosen from period 6, this number is reduced by half to about 2 atoms per 10,000 atoms of silver. Smith and Trivelli set out as a preferred maximum less than approximately 20 mg/100 grams of silver, which amounts to only about 2 atoms of group VIII 5 metal or 1 atom of group VIII 6 metal per 10,000 atoms of silver. At the minimum level of 0.8 mg/100 grams of silver, only about 8 atoms of group VIII 5 metal or about 4 atoms of group VIII 6 metal per million silver atoms is present in the emulsions of Smith and Trivelli. Thus, adjacent cation lattice position placement of group VIII 5/6 metal ions cannot be achieved by employing hexacoordination complexes each containing a single group VIII 5/6 metal ion as taught by Smith and Trivelli.

It has been discovered that adjacent cation site placement of group VIII 5/6 metal ions in the face centered cubic lattice structure of silver halide grains can be achieved by introducing into the emulsion an oligomeric hexacoordination complex containing at least two group VIII 5/6 metal atoms. Although polymeric and oligomeric hexacoordination complexes are known having a higher number of group VIII 5/6 metal ions, those oligomers are preferred which contain up to about 20 group VIII 5/6 metal atoms. Specifically preferred are oligomers that contain about 6 to 10 group VIII 5/6 metal atoms.

The oligomeric coordination complexes contain two or more group VIII 5/6 metal atoms linked by bridging ligands. For comparison, when the compound of formula (I) above is dissolved, it dissociates into an anionic hexacoordination complex satisfying the following formula:

$$MX_6 \quad \text{(II)}$$

wherein

M is a group VIII 5/6 atom and

X is a halide ligand.

The six halide ligands are positioned around the group VIII 5/6 metal atom in the same way that the halide ions are positioned around a single silver ion in the face centered crystal lattice structure of FIG. 1. Imagining mutually perpendicular x, y and z axes intersecting at the group VIII 5/6 metal atom, two ligands lie along each of these three axes equally spaced from the group VIII 5/6 metal atom. A corresponding anionic hexacoordination complex containing two group VIII 5/6 metal atoms is represented by the following formula:

$$M_2L_{10} \quad \text{(III)}$$

wherein

M is as previously defined and

L is a halide or other bridging ligand.

The difference between this anionic dimer and two anions satisfying formula II is that in the dimer the metal atoms share two bridging ligands, reducing the number of ligands required from 12 to 10. For oligomeric complexes containing up to five metal atoms the following general formula can be written to describe the anions:

$$M_mL_{6+4(m-1)} \quad \text{(IV)}$$

where M and L are as previously defined and m is from 2 to 5. When the number of group VIII 5/6 metal atoms reaches six, a ring structure becomes possible made up of six group VIII 5/6 metal atoms and pairs of shared bridging ligands linking adjacent metal atoms. Although rings having higher numbers of group VIII metal atoms are possible, most higher molecular weight oligomers consist of rings containing six group VIII 5/6 metal atoms, usually with a pair of metal atoms in one ring shared with a pair of metal atoms in an adjacent ring. The following are exemplary of oligomeric anions satisfying the requirements of the invention containing 6, 8 or 10 group VIII 5/6 metal atoms:

$M_6L_{24}$ (V)

$M_8L_{32}$ (VI)

$M_{10}L_{38}$ (VII)

wherein M and L are as previously defined. Other oligomeric forms containing 6, 8 or 10 group VIII 5/6 metal atoms are, of course, possible.

The net negative charge of the anions above is not indicated, since this depends upon the choice of the group VIII 5/6 metal and the ligand, the more electronegative ligands tending to shift the group VIII 5/6 metal to a higher oxidation state and the differing group VIII 5/6 metals exhibiting differing oxidative state preferences. For anions containing iridium and halide ligands, the net negative charge of the anion in formula II is −2, in formula III −4, in formula V −6, and in formulae VI and VII −8. With anionic hexacoordination complexes having negative charges ranging from −2 to −8 all having been demonstrated to be effective, it is apparent that the magnitude of net negative charge has little, if any, influence on the desired lattice placements.

The important point to observe is that all of the molecular weight and sterically varied oligomers contemplated for use in the practice of this invention exhibit a pattern of alternating group VIII 5/6 atoms and ligands similar to that found in the face centered cubic crystal lattice structure of a radiation sensitive silver halide grain. Thus, the oligomers are capable of presenting the group VIII metal atoms of the oligomers to the surface of the crystal lattice structure as it is being formed so that adjacent group VIII 5/6 atoms are oriented to occupy adjacent cation sites of the crystal lattice structure. Although not investigated, it should be possible to achieve adjacent incorporations of group VIII metal atoms employing oligomeric tetracoordination complexes in place of hexacoordination complexes.

The bridging ligands are capable of forming covalent bonds with two adjacent group VIII 5/6 metal atoms. In their simplest form the ligands can be halides, such as fluoride, chloride, bromide, or iodide atoms. For size compatibility with the face centered cubic crystal lattice structure of silver halide grains the ligands are preferably chloride or bromide ligands.

As taught by Janusonis et al, Keevert et al, Marchetti et al, and McDugle et al, each cited above and here incorporated by reference, other bridging ligand choices in addition to halide ions are possible. For example, to a limited extent aquo ($H_2O$) ligands can be substituted for halide ligands. Pseudohalogen ligands, such as cyanide (CN), cyanate (OCN), thiocyanate (SCN), selenocyanate (SeCN), and tellurocyanate (TeCN) ligands are contemplated. Still other ligands, such as nitrosyl (NO), thionitrosyl (NS), azide ($N_3$), oxo (O), and carbonyl (CO) ligands are possible. In choosing ligands other than halide and aquo ligands it must be borne in mind that the ligands can themselves affect photographic performance. When the ligands are the same halide as that of the grain structure, modifying effects are entirely attributable to the group VIII 5/6 metal ions incorporated. Similarly, aquo ligands have not been reported to produce modifying effects.

The anionic hexacoordination complexes paired with one or more charge satisfying cations, such as any of those indicated above satisfying R in formula I, can be introduced as a particulate solid or in solution at any stage of emulsion preparation employing any convenient conventional technique for hexacoordination complex addition—e.g., as taught by Smith and Trivelli, cited above and here incorporated by reference. To insure incorporation of the group VIII 5/6 metal in the crystal structure it is preferred to have the hexacoordination complex present during grain formation. Having the complex present before or during silver halide precipitation is contemplated. Also the group VIII 5/6 metal can be effectively incorporated by having the complex present while surface ripening of the grains is occurring—i.e., having the complex and one or more ripening agents concurrently present in the emulsion.

Apart from the features specifically described above, the emulsions can take any convenient conventional form. Conventional features of photographic emulsions and photographic elements constructed from these emulsions are summarized in *Research Disclosure*, Vol. 307, Nov. 1989, Item 307105, pp. 863–885, here incorporated by reference. *Research Disclosure* is published by Kenneth Mason Publications, Ltd., Dudley Annex, 21a North Street, Emsworth, Hampshire P010 7DQ, England.

Preparation of oligomeric hexacoordination complexes of group VIII 5/6 metals of the type employed in the practice of this invention can be achieved by reference to published techniques for preparing these and related coordination complexes and by referring to the preparations presented in the examples. Relevant coordination complex synthetic teachings are illustrated by B. Krebs et al, Z. Naturforsch, 39b, p. 843 (1984); F. A. Cotton et al, Inorg. Chem., 16, p. 1865 (1977); F. A. Cotton et at., Polyhedron, 6, p. 667 (1987); H. J. Steinbach et al, Z. Anorg. Allgem. Chem., 530, p. 1 (1985); and N. M. Sinitsyn et al, Russian Journal of Inorganic Chemistry, 27, p. 92 (English text) (1982).

EXAMPLES

The invention can be better appreciated by reference to the following specific examples.

CONTROL 1

OHCC-1: $K_3[IrCl_6]3H_2O$

EXAMPLE 1

Synthesis of Iridium Dimer

OHCC-2: $K_4[Ir_2Cl_{10}]$

OHCC-1 was prepared by the procedure of N. M. Sinitzyn et al, cited above. This was a solid state thermal polymerization of aquated monomers using thermogravimetric analysis (TGA) profile information to establish the desired heat range. The basis of the reaction was to generate proximal coordinatively unsaturated fragments which subsequently dimerize through a pair of mu-2 halide linkages. A temperature-controlled tube furnace operation at 285° C. was used to heat 1.455 g of recrystallized $K_2IrCl_5(H_2O)$ in a quartz tube in air for 45 minutes with observable amounts of water condensing on the cool portions of the tube. The resulting green powder (as opposed to the brown starting material) weighed 1.372 g after heating (5.7% wt. loss). This was near the expected value of 4 percent. The solid was readily soluble in water to give a solution with an absorbance peak at 404 nm (173 $M^{-1}cm^{-1}$) with a high absorbance slope toward 300 nm (545 $M^{-1}cm^{-1}$ at 300 nm).

EXAMPLE 2

Synthesis and Purification of Cyclic Iridium Oligomers

OHCC-3: $K_6[Ir_6Cl_{24}]12H_2O$
OHCC-4: $K_8[Ir_8Cl_{32}]12H_2O$ (boat form)
OHCC-5: $K_8[Ir_8Cl_{32}]12H_2O$ (chair form)
OHCC-6: $K_8[Ir_{10}Cl_{38}]16H_2O$ OHCC-3, -4, -5, and -6 were isolated in yields of from about 0.5 to 3% by wt of iridium by ultrafiltration of impure solutions of $K_3IrCl_6$ through UM-20 or YCO5 Amicon TM membranes.

The $K_3IrCl_6$ was obtained in the following manner: One gram of $IrCl_3nH_2O$ and 0.2 g KCl were heated in 20 mL of 0.1N HCl for 30 minutes. The mixture was then taken to dryness on a rotary evaporator. The dried residue was heated at 160° C. for 4 hours. Concentrated HCl (10 mL) was added to the residue and the mixture was refluxed overnight, cooled and diluted with 10 mL distilled water. The solution was adjusted to pH 2 (approx.) with KOH. The precipitated $K_3IrCl_6$ was then separated by filtration. The remaining mother liquor was subjected to ultrafiltration with water washes to yield 35 mg of the iridium oligomers. The yellow-brown solution of oligomers were unable to permeate the ultrafiltration membrane while the simple salts and monomeric iridium complexes did.

A Sephadex G-25 TM gel permeation chromatographic separation was used to isolate the individual iridium oligomer components. Careful chromatography using long thin channel-free columns (approx. 400×5 mm) loaded to less than 5 mm from the top with saturated aqueous solutions with water elution rates of 0.1 to 1 mL per minute coupled with experienced observation to detect and collect the central parts of the incompletely resolved bands permitted separation. A central "band" in the column consisting of three poorly resolved component bands contained the four iridium oligomers identified above.

Slow evaporation of the three fractionated component bands yielded two configurations of octamers OHCC-4 and -5 (boat and chair steric configurations separated via fractional recrystallization) from the lower component band, a hexamer OHCC-3 from the central component band accounting for 50 percent by weight of all oligomers obtained, and a bicyclic decamer OHCC-6 from the upper component band.

All four of the purified oligomers crystallized readily from aqueous solution and remained stable toward aquation. The crystals were also stable in air aside from the slow loss of water of crystallization.

EXAMPLE 3

Photographic Speed Enhancement

A monodisperse silver bromide octahedral emulsion of 0.28 μm edge length was prepared by a double-jet precipitation technique. Portions of the emulsion were then chemically sensitized with a variety of iridium complexes by means of the following bromide shelling technique:

The emulsion was melted at 40° C., the pH adjusted to 6.2, the pBr adjusted to 2.0, and 83 molar parts per million of 1,10-dithia-4,7,13,16-tetraoxacyclooctadecane was added. A constant volume of various iridium sensitizers ($10^{-7}$ to $10^{-10}$ M in Ir) or distilled water were added to aliquots of the emulsion, and the emulsions were held for 10 minutes at 40° C. A very fine grain, <0.05 μm, silver bromide emulsion was then added in an amount equal to 10 percent of the portion of the aliquots, the pH and pBr were adjusted as above, and the emulsions were held, with constant agitation for 30 minutes at 40° C.

The chemically sensitized emulsions were then coated on a cellulose triacetate film support at coverages of 1.07 g silver per square meter, and 7.53 g of gelatin per square meter. The resulting photographic elements were exposed for 1 second to a 5500° K. light source through a graduated density filter and developed for 24 minutes in Kodak Rapid X-Ray TM developer, a hydroquinone-N,N-dimethyl-p-aminophenol hemisulfate developer.

The iridium complexes employed, their concentrations, and a calculation of the average number of molecular ions per grain, assuming complete grain incorporation, is provided below in Table I along with sensitometric results.

TABLE I

| Sensitizer | mg/Ag mole | mol. ions/grain | Δlog E |
|---|---|---|---|
| None | 0 | 0 | R.P.* |
| OHCC-1 | 0.014 | 5 | 0.01 |
| OHCC-1 | 0.138 | 50 | 0.25 |
| OHCC-1 | 0.277 | 100 | 0.25 |
| OHCC-2 | 0.013 | 3 | 1.2 |
| OHCC-3 | 0.023 | 2 | 1.45 |
| OHCC-3 | 0.057 | 5 | 1.56 |
| OHCC-3 | 0.115 | 10 | 1.60 |
| OHCC-4 | 0.031 | 2 | 0.72 |
| OHCC-4 | 0.079 | 5 | 1.22 |
| OHCC-4 | 0.157 | 10 | 1.40 |
| OHCC-4 | 0.236 | 15 | 1.48 |
| OHCC-6 | 0.018 | 0.8 | 0.76 |
| OHCC-6 | 0.045 | 2 | 1.27 |
| OHCC-6 | 0.089 | 4 | 1.41 |
| OHCC-6 | 0.134 | 6 | 1.48 |

*Reference for measurement of speed differences

The data in Table I illustrate that oligomers of the present invention confer a much higher degree of chemical sensitization at similar iridium ion concentration levels than the monomeric iridium coordination complex employed as a control.

EXAMPLE 4

Reduction of Low Intensity Reciprocity Failure (LIRF)

A tabular grain silver bromoiodide (1.5 mole percent iodide) emulsion having a mean equivalent circular diameter of 5.3 μm and a mean grain thickness of 0.10 μm (>50% of total grain projected area accounted for by tabular grains) was prepared by a method similar to that described in Example 1 of Solberg et al U.S. Pat. No. 4,433,048.

A portion of the emulsion was chemically sensitized by adding 10.8 mg of 3-methyl-1,3-benzothiazole iodide, 100 mg of sodium thiocyanate, 200 mg of anhydro-5,5,'-dichloro-3,3'-bis(3-sulfopropyl)thiacyanine hydroxide, 0.5 mg of sodium thiosulfate pentahydrate, and 1.0 mg of potassium tetrachloraurate, per silver mole. The emulsion was then heated to 70° C. and digested for 10 minutes.

A second portion of the emulsion was chemically sensitized in the same manner, except that the sulfur and gold sensitizing reagents were replaced by 5.0 micrograms of OHCC-3.

The resulting chemically and spectrally sensitized tabular grain emulsions were each coated on cellulose acetate film supports. The coating format was an emulsion layer comprising tabular silver bromoiodide grains (1.35 g/m$^2$), gelatin (2.5 g/m$^2$), and the yellow dye-forming coupler α-pivalyl-α-[4-(4-hydroxybenzenesulfonyl)phenoxy]-2-chloro-5-(n-hexadecanesulfonamido)acetanilide (0.91 g/m$^2$), a gelatin overcoat layer comprising gelatin (0.54 g/m$^2$), and the hardener bis(vinylsulfonylmethyl) ether at a level of 0.5 percent, based on total gelatin.

The coated photographic elements were evaluated for reciprocity response by giving them a series of calibrated (total energy) exposures ranging from 1/10,000th of a second to 10 seconds, followed by development for 6 minutes in Kodak Rapid X-Ray TM developer. For the two extremes of exposure time (i.e., 1/10,000th sec. and 10 sec.) a threshold speed point was obtained by extrapolating the lower scale of the sensitometric curve and taking as the speed point the point at which the extrapolated line intercepted the minimum density.

The results are shown in Table 2.

TABLE 2

| Sensitizers | Relative Log Sensitivity | | |
|---|---|---|---|
| | 1/10.000 sec | 10 sec | LIRF |
| Sulfur Gold Thiocyanate | 177 | 167 | −10 |
| OHCC-3 Thiocyanate | 176 | 172 | −4 |

From Table 2 it is apparent that the substitution of the iridium oligomer (example) sensitization for sulfur and gold (control) sensitization results in high intensity exposure response almost identical to that of the control. At the lower intensity exposure the control shows a pronounced low intensity reciprocity failure while the example exhibits a much lower loss of sensitivity.

EXAMPLE 5

Oligomer Mixtures

When Example 4 was repeated, but using a mixture of OHCC-3 and OHCC-4, similar results were obtained, indicating that satisfactory results can be achieved with mixtures of oligomers. This is important because this allows the oligomer preparation steps to be simplified by omitting oligomer separation and purification steps.

EXAMPLE 6

Bromide Ligands

Example 5 was repeated, but with OHCC-3 and OHCC-4 modified by the substitution of bromide ligands for chloride ligands. The photographic response was essentially similar, indicating that bromide and chloride ligands are equally attractive.

The invention has been described in detail with particular reference to preferred embodiments thereof, but it will be understood that variations and modifications can be effected within the spirit and scope of the invention.

What is claimed is:

1. A photographic silver halide emulsion comprised of radiation sensitive silver halide grains exhibiting a face centered cubic crystal lattice structure containing, on average, at least one pair of metal ions chosen from group VIII, periods 5 and 6, at adjacent cation sites of the crystal lattice.

2. A photographic silver halide emulsion comprised of radiation sensitive silver halide grains exhibiting a face centered cubic crystal lattice structure containing at cation sites of the crystal lattice metal ions chosen from group VIII, periods 5 and 6 characterized in that, on average, at least five pairs of adjacent cation sites of said crystal lattice are occupied by said group VIII metal ions.

3. A photographic silver halide emulsion comprised of radiation sensitive silver halide grains exhibiting a face centered cubic crystal lattice structure containing at cation sites of the crystal lattice metal ions chosen from group VIII, periods 5 and 6 characterized in that, on average, at least ten pairs of adjacent cation sites of said crystal lattice are occupied by said group VIII metal ions.

4. A photographic silver halide emulsion according to claim 1 further characterized in that said grains contain from 2 to 20 of said group VIII metal ions linked to each other by bridging ligands.

5. A photographic silver halide emulsion according to claim 1 further characterized in that said grains contain from 6 to 10 of said said group VIII metal ions linked to each other by bridging ligands.

6. A photographic silver halide emulsion according to claim 1 further characterized in that said face centered cubic lattice structure contains anions between said adjacent cation site group VIII metal ions differing from remaining anions in said face centered cubic crystal lattice structure.

7. A photographic silver halide emulsion according to claim 6 further characterized in that said anions between said adjacent cation site group VIII metal ions are halide ions.

8. A photographic silver halide emulsion according to claim 6 further characterized in that said anions between said adjacent cation site group VIII metal ions are pseudohalide ions chosen from the group consisting of cyanide, cyanate, thiocyanate, selenocyanate, and tellurocyanate anions.

9. A photographic silver halide emulsion according to any one of claims 1 to 8 inclusive further characterized in that said group VIII metal ions are iridium ions.

10. A method of preparing a photographic emulsion comprising forming radiation sensitive silver halide grains exhibiting a face centered cubic crystal lattice structure containing metal ions chosen from group VIII, periods 5 and 6, characterized in that the group VIII metal ions are supplied in the form of oligomers each providing at least two of the group VIII metal ions.

11. A method of preparing a photographic emulsion according to claim 10 further characterized in that said oligomers each provide from 2 to 20 of the group VIII metal ions.

12. A method of preparing a photographic emulsion according to claim 11 further characterized in that said oligomers each provide from 6 to 10 of the group VIII metal ions.

13. A method of preparing a photographic emulsion according to claim 10 further characterized that the oligomers are introduced into the face centered cubic crystal lattice structure as anionic hexacoordination complexes consisting essentially of the group VIII metal ions and bridging ligands.

14. A method of preparing a photographic emulsion according to claim 13 further characterized in that the bridging ligands are halide ions.

15. A method of preparing a photographic emulsion according to claim 13 further characterized in that the bridging ligands are pseudohalide ions chosen from the class consisting of cyanide, cyanate, thiocyanate, selenocyanate, and tellurocyanate ions.

16. A method of preparing a photographic emulsion according to claim 10 further characterized in that the anionic oligomers are selected from among those satisfying the formulae:

$M_2L_{10}$ $M_6L_{24}$ $M_8L_{32}$ and $M_{10}L_{38}$ where

M represents a group VIII, period 5 or 6, element and L represents a bridging ligand.

17. A method of preparing a photographic emulsion according to claim 16 further characterized in that L is chosen from among halide and pseudohalide ions.

18. A method of preparing a photographic emulsion according to claim 17 further characterized in that M is iridium.

19. A method of preparing a photographic emulsion according to claim 10 further characterized in that at least five group VIII metal ions are introduced per grain.

20. A method of preparing a photographic emulsion according to claim 19 further characterized in that at least ten group VIII metal ions are introduced per grain.

* * * * *